US005556003A

United States Patent [19]

Johnson et al.

[11] Patent Number: 5,556,003

[45] Date of Patent: Sep. 17, 1996

[54] HAND-HELD PERSONAL DEFENSE APPARATUS

[75] Inventors: Douglas A. Johnson; Vince E. Johnson, both of Charlotte; Feliciano S. Sabates, III, Davidson, all of N.C.

[73] Assignee: Johnson, Sabates & Johnson LLC, Davidson, N.C.

[21] Appl. No.: 526,586

[22] Filed: Sep. 11, 1995

[51] Int. Cl.[6] ..... B67D 5/00

[52] U.S. Cl. ..... 222/39; 116/DIG. 44; 222/153.11; 222/175; 222/192; 222/402.11; 273/84 R; 362/102; 482/3; 482/108

[58] Field of Search ..... 116/DIG. 44; 222/39, 222/192, 153.11, 175, 183, 113, 402.11; 42/1.08, 1.16; 340/574; 273/84 R; 482/106, 108, 1, 3, 8; 362/96, 101, 102, 109, 205

[56] References Cited

U.S. PATENT DOCUMENTS

| | | | |
|---|---|---|---|
| 1,018,358 | 2/1912 | Litsey | 362/102 |
| 3,484,023 | 12/1969 | Meshberg | 222/402.11 |
| 3,756,467 | 9/1973 | Anketell | 222/153.11 X |
| 4,220,996 | 9/1980 | Searcy | 482/3 X |
| 4,247,844 | 1/1981 | Zapolski et al. | 222/39 X |
| 4,324,351 | 4/1982 | Meshberg | 222/402.11 |
| 4,434,914 | 3/1984 | Meshberg | 222/402.11 X |
| 4,449,474 | 5/1984 | Mariol | 116/DIG. 44 X |
| 4,463,879 | 8/1984 | Des Voignes | 222/175 |
| 5,086,377 | 2/1992 | Roberts | 362/102 |
| 5,242,349 | 9/1993 | Reiff et al. | 482/108 X |
| 5,286,244 | 2/1994 | Wright et al. | 482/3 X |
| 5,287,995 | 2/1994 | Redman et al. | 222/183 X |
| 5,318,492 | 6/1994 | Quinn | 273/84 R X |
| 5,325,997 | 7/1994 | Washington et al. | 222/192 X |
| 5,332,119 | 7/1994 | Davis | 428/108 X |
| 5,405,134 | 4/1995 | Wolfram | 362/102 X |
| 5,458,263 | 10/1995 | Ciammitti et al. | 222/153.11 |
| 5,476,192 | 12/1995 | Julinot | 116/DIG. 44 X |

*Primary Examiner*—Kevin P. Shaver

*Attorney, Agent, or Firm*—Christopher C. Dremann; Ralph H. Dougherty

[57] ABSTRACT

A hand-held personal defense apparatus for protecting a user against an attacker includes a hollow housing defining an elongate handgrip. An aerosol canister of a defense fluid, such as tear gas, MACE® or (cayenne) pepper gas, and a battery-powered siren are positioned within the housing. The apparatus further includes a strike bar connected to the housing and extending forwardly in spaced relation from the handgrip so that the hand of the user may surroundingly grip the handgrip with the strike bar exposed on the outside of the hand. The strike bar serves as a visible deterrent to an attacker may be used as a defensive weapon against the attacker. The apparatus further includes a movable actuator button for selectively activating the alarm or the alarm and the canister of defense fluid. The actuator button may be positioned in a safety position wherein the user cannot readily activate the alarm or the defense fluid; in a ready position wherein the user can rotate the actuator button to activate the alarm, and can depress the actuator button to activate the alarm and the defense fluid simultaneously; and an alarm position wherein the alarm is activated, and the user can depress the actuator button to activate the defense fluid. A companion exercise apparatus is also disclosed that includes a stop watch and a pedometer in place of the actuator button, a flashlight in place of the canister of defense fluid, and a storage compartment in place of the alarm.

18 Claims, 5 Drawing Sheets

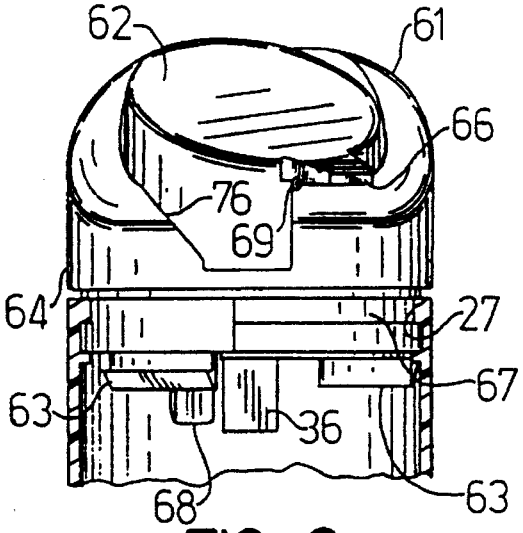
FIG. 9a.
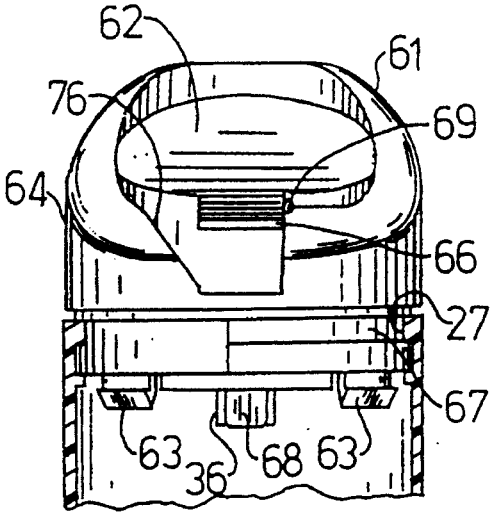
FIG. 9c.
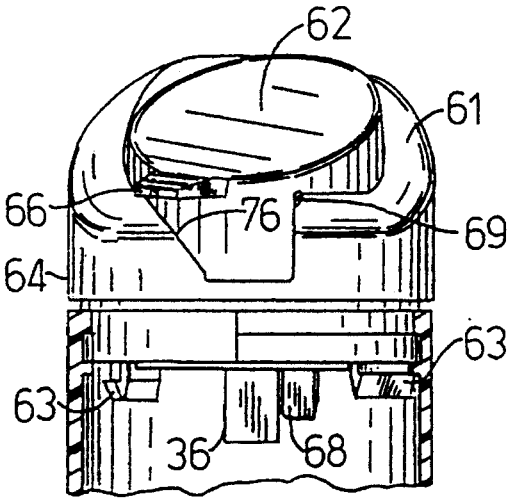
FIG. 9b.
FIG. 9d.
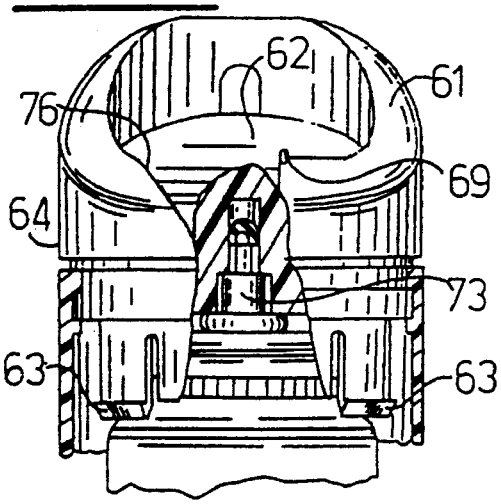
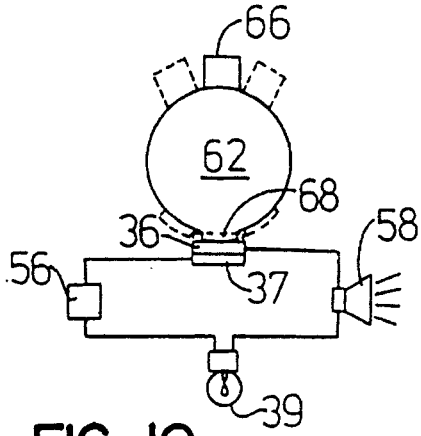
FIG. 10.

HAND-HELD PERSONAL DEFENSE APPARATUS

FIELD OF THE INVENTION

The invention relates to a hand-held personal defense apparatus for protecting a user against an attacker, and more particularly, to a hand-held personal defense apparatus for use by an exerciser.

BACKGROUND OF THE INVENTION

There are many situations in which the personal safety of an individual, particularly a female, is at risk from an attacker. Violent crimes, such as robbery, rape and assault, frequently occur while the victim is walking to or from a vehicle or a residence. The crimes of molestation, rape and assault, in particular, are oftentimes directed at exercisers, such as walkers, hikers and joggers, who are preoccupied with the exercise activity and thus are vulnerable to a sudden attack. Exercisers are also vulnerable to an attack because it is difficult to carry a device for protecting against an attack, herein referred to as a personal defense apparatus, while exercising.

In response to the need for protection against an attack while exercising, many hand-held personal defense apparatus are now available. Conventional personal defense apparatus include an audible alarm and/or an aerosol canister of a defense fluid, such as tear gas, MACE® or (cayenne) pepper gas. Such devices, however, are not appropriate for use in all situations.

U.S. Pat. No. 4,463,879 issued Aug. 7, 1984 to Des Voignes discloses a device for securing an attack repellant, such as an audible alarm powered by pressurized gas from an aerosol canister or a defense fluid discharged from an aerosol canister, that permits the user to activate the repellent during an attack in which the user's arms are restrained. The device includes an adjustable strap that secures the repellant to the palm of one of the user's hands so that the repellant can be activated using only the fingers or the thumb of one hand. Because the device is held within the palm of the user's hand, however, it is not readily visible to the attacker and therefore does not provide a visible deterrent.

Further, the user must select either an aerosol canister that operates an audible alarm or an aerosol canister that discharges a defense fluid to be secured by the device. An audible alarm, however, is effective only in a populated area where the assistance of a rescuer is readily available. In remote areas, such as parks and nature trails where exercise is typically conducted to avoid automobile traffic and congestion, an audible alarm may not be effective to summon assistance. The rescuer may be too far away to hear the alarm, or the attacker may be able to overcome the victim and disable the alarm before the rescuer is able to locate the scene of the attack.

An aerosol canister of defense fluid is likewise not always effective. Many states, in fact, impose restrictions on the sale and use of products that discharge defense fluids. Even where the use of a product that discharges a defense fluid is permitted, if attacked from behind the victim may be unable to direct the nozzle of the aerosol canister at the attacker. Accordingly, because a victim cannot always predict where and how an attack may occur, the device of the Des Voignes patent does not provide an effective means for protecting a user, and particularly an exerciser, against an attacker.

U.S. Pat. No. 5,332,119 issued Jul. 26, 1994 to Davis discloses a personal defense apparatus in the form of an exercise weight equipped with an aerosol canister contained in a housing spaced outwardly from the handgrip of the apparatus. The apparatus provides a visual deterrent to the attacker. The nozzle of the defense fluid canister, however, is directed upwardly and includes a trigger mechanism that is difficult to activate with only the fingers and thumb of one hand. Typically, an attacker does not permit the victim such free use of both hands as would be required to activate the defense fluid canister of the apparatus. Further, the Davis apparatus is ineffective when the victim is attacked from behind and is unable to direct the nozzle of the defense fluid canister at the attacker.

U.S. Pat. No. 5,325,997 issued Jul. 5, 1994 to Washington et al. discloses a similar hand-held exercise weight combined with an aerosol canister containing a defense fluid. A removable weight is attached to the lower end of a hollow handgrip housing the defense fluid canister, and a hand strap is provided between the lower end and the upper end of the handgrip. The palm of the user's hand is placed around the handgrip with the fingers of the hand between the handgrip and the hand strap. Accordingly, the fingers and the thumb of the user's hand are not immediately free to activate the defense fluid canister of the apparatus. Further, exercise weights of the type disclosed in the Washington patent are typically used in pairs to balance the increased resistance to the movement of the arm of the exerciser. Thus, the user must direct the nozzle of the defense fluid canister at the attacker and activate the defense fluid canister with the fingers and thumb of only one hand.

U.S. Pat. No. 5,242,349 issued Sep. 7, 1993 to Rife et al. discloses an exercise apparatus in the form of a dumbbell including a handgrip spaced between ball-shaped weights at opposite ends of the apparatus. In different embodiments, the apparatus includes either an extensible club to strike an attacker, or an audible alarm for summoning help, or an aerosol canister containing defense fluid for temporarily incapacitating an attacker. The user of the Rife apparatus, however, must predict which of the different embodiments will be most effective for defending against a particular attack before the attack occurs. As previously discussed, an audible alarm and a canister of defense fluid may be ineffective depending on the location and the manner of the attack. A club, likewise, may be ineffective under certain circumstances, for example when the victim's arms are restrained by the attacker.

It is apparent that the prior art does not provide a hand-held personal defense apparatus that is effective for the different situations in which an attack against an individual, particularly an exerciser may occur. None of the prior art devices alone adequately protect an exerciser against an attack which occurs in a remote area where a rescuer cannot hear an audible alarm, or against an attack in which the arms of the victim are restrained so that the victim is unable to direct the nozzle of an aerosol canister of defense fluid at an attacker and to discharge the defense fluid.

SUMMARY OF THE INVENTION

In view of the noted deficiencies in the prior art, it is an object of the invention to provide a hand-held personal defense apparatus for protecting a user against an attacker in different situations.

It is another, and more particular, object of the invention to provide a hand-held personal defense apparatus for an exerciser, such as a walker, hiker or jogger.

It is another object of the invention to provide a hand-held personal defense apparatus that includes a defensive weapon which also serves as a visible deterrent to an attacker.

It is another object of the invention to provide a hand-held personal defense apparatus including an actuator button for selectively activating an alarm or an alarm and an aerosol canister of a defense fluid such as tear gas, MACE® or pepper gas According to the invention, a hand-held personal defense apparatus preferably includes a hollow housing defining an elongate handgrip, a strike element connected to the housing and extending forwardly in spaced relation from the handgrip, an alarm means for producing an audible alarm, a defense fluid means for discharging a defense fluid, and an actuator assembly for selectively activating the alarm means or the alarm means and the defense fluid means. The combination of the strike element, the alarm means, and the defense fluid means insures that an individual, particularly an exerciser such as a walker, hiker, or jogger, is protected in different situations against an attacker.

The strike element preferably includes a strike bar that extends in spaced relation along at least a substantial portion of the length of the handgrip so that the hand of the user may surround the handgrip with the strike bar exposed on the outside of the hand in the direction of the attacker. The user inserts the fingers of one hand through the opening between the handgrip and the strike bar and grasps the handgrip between the palm and the fingers of the hand. The thumb of the hand rests on the actuator assembly ready to selectively activate the alarm means or the alarm means and the defense fluid means.

The strike bar is made of a hard, rigid, material such as plastic or metal. If necessary, the strike bar may be used to strike the attacker during an attack. Ideally, the strike bar, which resembles and functions similarly to a well known "brass knuckles", also serves as a visible deterrent to discourage the attacker from attacking the user. The forward-facing, exterior surface of the strike bar may include protrusions or may be serrated to provide a more effective defensive weapon.

In a preferred embodiment, the alarm means is positioned within the housing adjacent the lower end. Preferably, the alarm means includes an alarm circuit electrically connected to a battery for energizing a siren. Preferably, a first conducting wire extends between the alarm circuit and a pair of electrical contacts positioned adjacent the actuator assembly at the upper end of the housing. A second conducting wire preferably extends between the alarm circuit and a light emitting diode (LED) located on the forward-facing, exterior surface of the strike bar. When the contacts are in physical contact with one another, an electrical circuit is completed between the battery and the siren to produce an audible alarm for summoning assistance to the scene of the attack.

The defense fluid means is preferably positioned within the housing adjacent the upper end. Preferably, the defense fluid means includes an aerosol canister containing a defense fluid such as tear gas, MACE®, or (cayenne) pepper gas. The canister is pressurized and includes a release valve so that the defense fluid is discharged through a nozzle provided in the actuator assembly when the release valve is depressed by the actuator assembly. In a preferred embodiment, the canister of defense fluid is removable and replaceable when the defense fluid is expended or when using the apparatus in a jurisdiction where local laws restrict the use of a defense fluid.

The actuator assembly preferably comprises an actuator button and a collar for securing the button to the upper end of the housing. In a preferred embodiment, the actuator button is movable between an off or "safety" position, a "ready" position and an "alarm" position. In the safety position, the actuator button cannot be depressed to activate the alarm means or the alarm means and the defense fluid means. In the ready position, the alarm means and the defense fluid means can be activated by depressing the actuator button. In the alarm position, the alarm means is activated and the defense fluid means can be activated by depressing the actuator button.

The housing and the strike element of the apparatus are preferably formed of two molded plastic halves secured together by a plurality of screws. The alarm means and the defense fluid means are placed within one of the halves and the remaining half is secured with the screws. The actuator assembly is inserted into the upper end of the housing and preferably rotated so that at least one elongate, circumferential ridge on the inside of the housing engages a corresponding elongate, circumferential channel provided on the exterior of the collar of the actuator assembly to secure the actuator assembly on the housing. The actuator button can then be selectively positioned in the safety, ready, or alarm position.

In an alternative embodiment of the apparatus, the actuator button is replaced by a timing means, the defense fluid means is replaced by an illuminating means, and the alarm means is replaced by a storage means. The timing means preferably has the same peripheral shape as the actuator button and is secured by the collar adjacent the upper end of the housing of the body in the same manner. Preferably, the timing means includes a stop watch and a pedometer for recording time and distance information relating to the exercise activity, and corresponding displays for digitally displaying the time and distance information.

The illuminating means preferably includes a battery-operated flashlight positioned adjacent the upper end of the housing in place of the aerosol canister of the defense means. The lens of the flashlight preferably utilizes the opening in the actuator assembly for the nozzle of the defense fluid means. A control switch is provided on the collar of the actuator assembly for completing an electrical circuit between a pair of electrical contacts positioned adjacent the upper end of the housing and the battery of the flashlight. The control switch is located adjacent the displays of the timing means for convenient access during exercise, and the illuminating means may further include means for illuminating the displays of the timing means.

The storage means preferably includes a storage compartment positioned adjacent the lower end of the housing in place of the alarm means. A battery access door provided on the exterior of the housing for the alarm means is preferably utilized to access the storage compartment. The storage compartment is available for storing personal items commonly carried by an exerciser, such as money and keys. In a preferred embodiment, the LED of the alarm means is replaced by a plug for receiving a pulsemeter that is electrically connected to the display of the timing means.

Either of the embodiments of the personal defense apparatus described herein, or both, may be weighted so that the two embodiments have approximately equal weight. Thus, when used in combination, the personal defense embodiment and the exercise embodiment provide additional aerobic exercise benefit to the user. In this manner, the personal defense apparatus and the exercise apparatus function as exercise weights to increase the resistance applied to the arms of the user during the exercise activity. Regardless, it is apparent that the hand-held personal defense apparatus of the invention provides a unique combination of personal defense features for effectively protecting an exerciser against an attack in different situations.

BRIEF DESCRIPTION OF THE DRAWINGS

Having set forth some of the objects and advantages of the invention, other objects and advantages will appear as the description of the invention proceeds in conjunction with the following drawings in which:

FIG. 9*a* is a rear elevational view of the actuator assembly of the personal defense apparatus of FIG. 1 illustrating the actuator button in the safety position;

FIG. 9*b* is a rear elevational view of the actuator assembly of the personal defense apparatus of FIG. 1 illustrating the actuator button in the ready position;

FIG. 9*c* is a rear elevational view of the actuator assembly of the personal defense apparatus of FIG. 1 illustrating the actuator button in the alarm position;

FIG. 9*d* is a rear elevational view of the actuator assembly of the personal defense apparatus of FIG. 1 illustrating the actuator button in position to activate the alarm means and the defense fluid means;

FIG. 10 is a schematic illustrating in solid the actuator button and the alarm means of the personal defense apparatus of FIG. 1 in the alarm position, and illustrating in phantom the actuator button in the safety and ready positions;

DETAILED DESCRIPTION OF THE PREFERRED EMBODIMENTS

Figure 1:
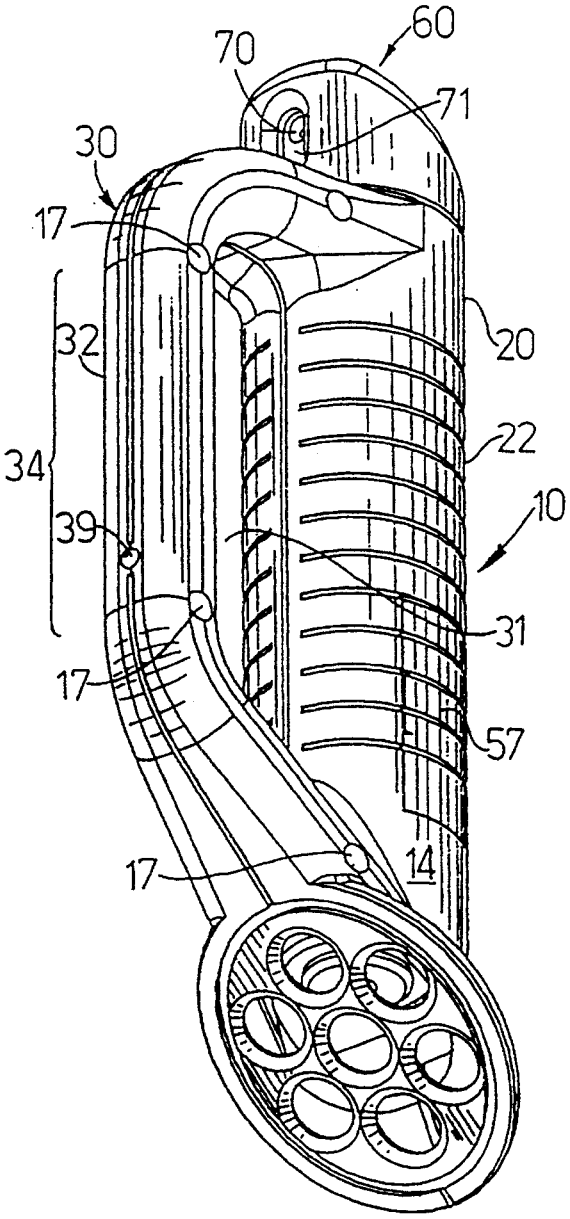
FIG. 1 is a front perspective view of a hand-held personal defense apparatus according to the invention.
Figure 2:
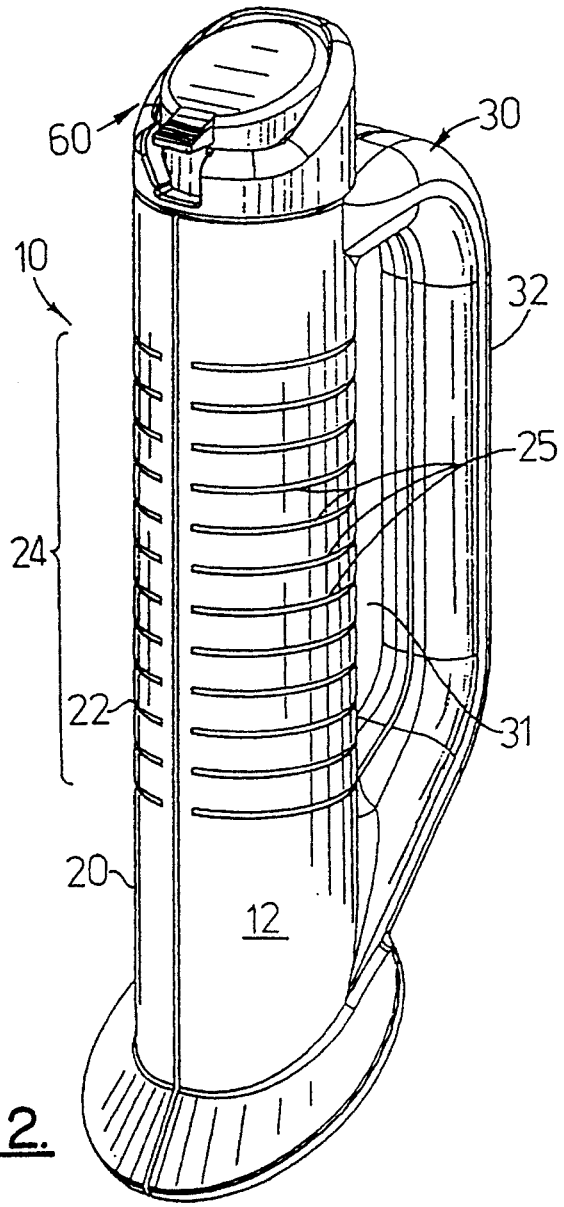
FIG. 2 is a rear perspective view of the personal defense apparatus of FIG. 1.

Referring to the accompanying drawings, FIGS. 1–4 illustrate a preferred embodiment of a hand-held personal defense apparatus according to the invention. The apparatus comprises a hollow housing 20, a strike element 30, a defense fluid means 40, an alarm means 50 and an actuator assembly 60. FIGS. 5–10 illustrate a preferred embodiment of the actuator assembly 60. The apparatus is particularly well suited for use by an exerciser, such as a walker, hiker or jogger, for protecting the user against an attacker. An exerciser is particularly vulnerable to a violent crime such as rape, molestation or assault, because exercise is often conducted in the early morning and late evening hours when it may be dark, and in remote areas to avoid traffic and congestion.

The apparatus preferably comprises a body 10 formed of a right half 12 and a left half 14 secured together, for example, with screws 16. In the preferred embodiment shown, right half 12 and left half 14 are not symmetric because right half 12 (FIG. 3) includes a base 18. Alternatively, however, right half 12 and left half 14 may be symmetric to reduce molding costs and base 18 may be molded separately and retained in a groove formed in the two halves. The halves 12, 14 are formed of a hard, rigid thermoplastic, such as polyethylene or polypropylene, that is lightweight, yet strong and durable. Right half 12 has a plurality, and preferably five as shown, internally threaded holes and left half 14 has a corresponding plurality of holes 17 (FIG. 1) therethrough for receiving screws 16 to secure the halves together.

When the halves 12, 14 are secured together, body 10 forms hollow housing 20 for receiving defense fluid means 40 and alarm means 50, and strike element 30 connected to housing 20. Housing 20 has a cavity 21 therein and comprises an exterior surface 22 defining a handgrip 24. As shown, hand grip 24 may comprise a series of parallel grooves 5 formed in exterior surface 22 that provide a sure gripping surface for the user to grip the apparatus hen the handgrip is wet, such as from perspiration. Handgrip 24 may also comprise a thin cover (not shown) made of a soft material, such as foam or felt to provide a soft surface for gripping the apparatus.

The housing 20 comprises an upper end 28 and a lower end 29 adjacent the base 18. As shown, the strike element 30 extends outwardly from the upper end 28 and the lower end 29 of housing 20. The strike element 30 comprises a strike bar 32 that extends in spaced relation along at least a substantial portion of the length of handgrip 24 so that the hand of the user may surroundingly grip the handgrip with the strike bar exposed on the outside of the hand. The strike bar 32 and the handgrip 24 define an opening 31 therebetween through which the user may insert the fingers of one hand to grasp the handgrip between the palm and the fingers of the hand.

Strike element 30, and particularly strike bar 32, is likewise made of a hard, rigid, plastic material, such as polyethylene or polypropylene. Strike bar 32 comprises a forward-facing, exterior surface 34 for striking, if necessary, an attacker during an attack. The strike element 30 has the familiar appearance of "brass knuckles" to serve as a visual deterrent to an attacker. As shown, the forward-facing, exterior surface 34 of strike element 30 is smooth. Surface 34 may, however, comprise a plurality of sharp projections or may be serrated for increasing the effectiveness of the strike bar 32 as a defensive weapon against an attacker.

Figure 3:
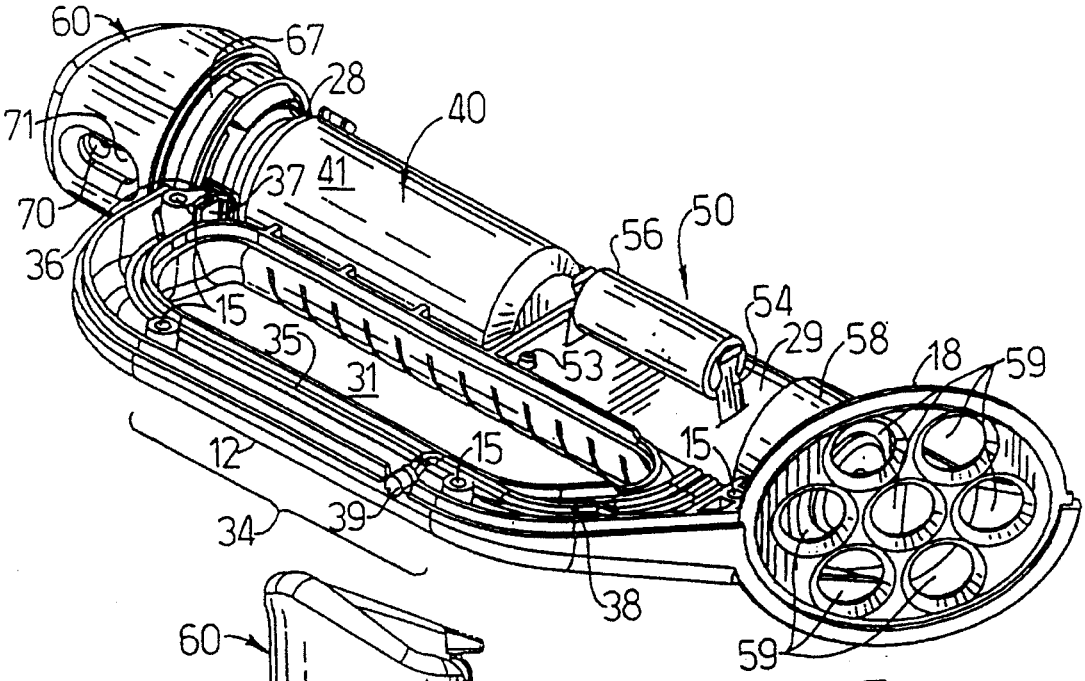
FIG. 3 is a front perspective view of the right half and the actuator assembly of the personal defense apparatus of FIG. 1.
Figure 4:
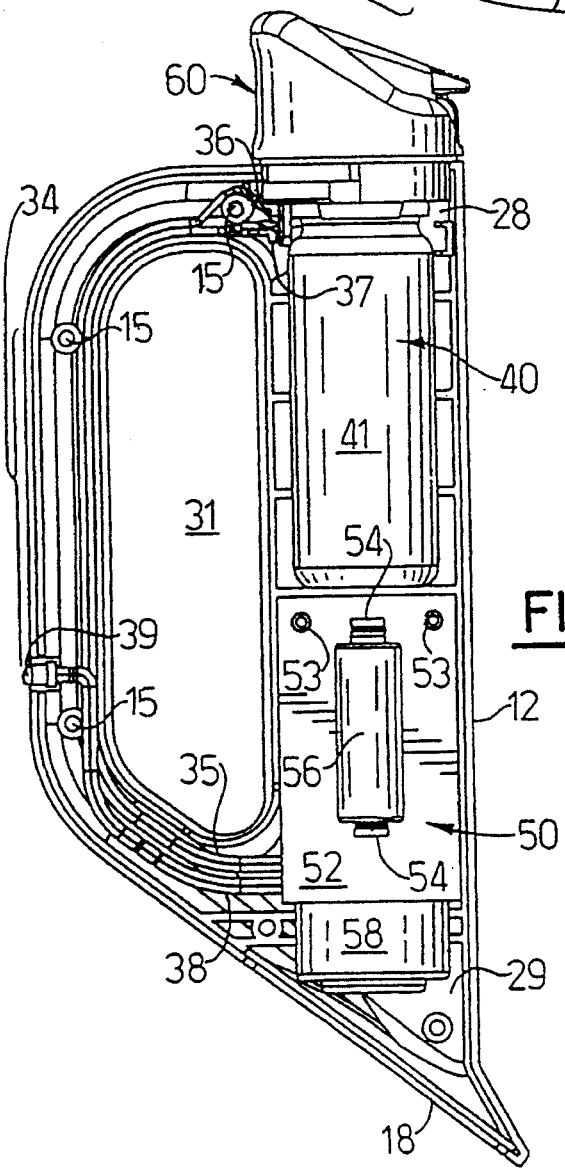
FIG. 4 is a side elevational view of the right half and the actuator assembly of the personal defense apparatus of FIG. 1.
Figure 5:
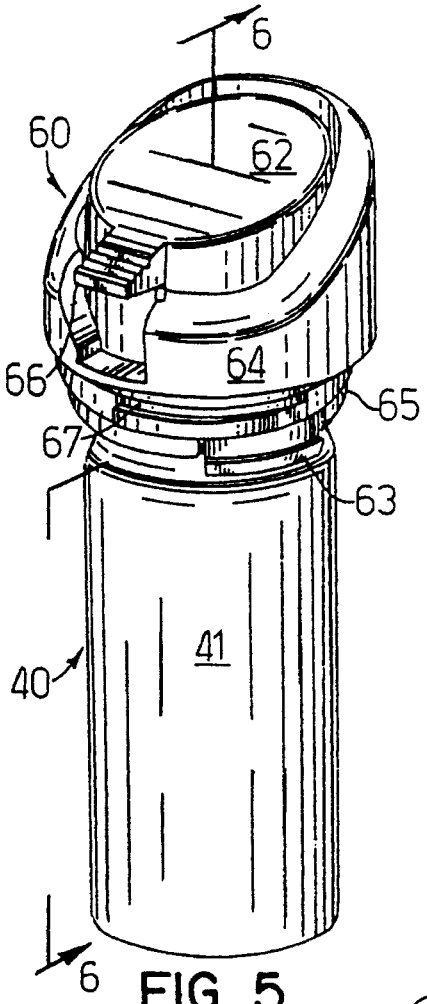
FIG. 5 is a rear perspective view of the actuator assembly and the defense means of the personal defense apparatus of FIG. 1.
Figure 6:
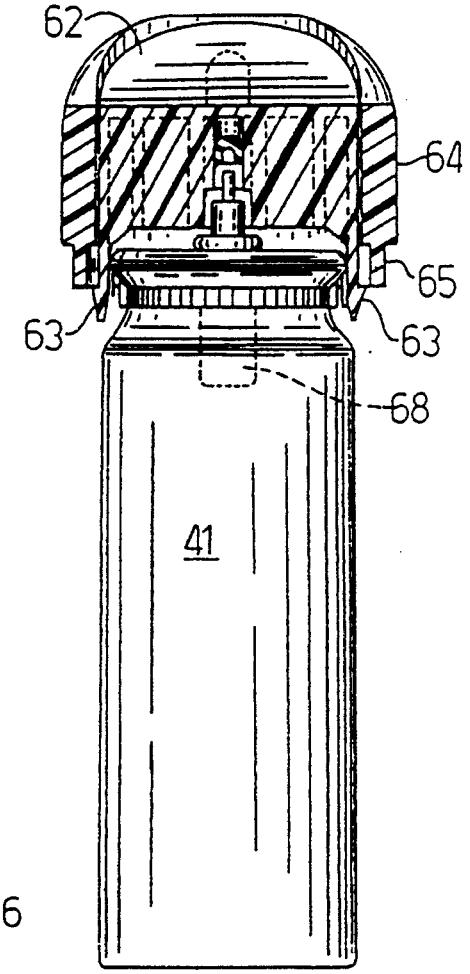
FIG. 6 is a partial sectional view of the actuator assembly and the defense means of the personal defense apparatus of FIG. 5 taken along line 6—6.

As best illustrated in FIGS. 3 and 4, strike element 30 is preferably hollow for receiving a first electrical conducting wire 35 electrically connecting actuator assembly 60 and alarm means 50, and a second electrical conducting wire 38 electrically connecting a light emitting diode (LED) 39 and alarm means 50. Electrical conducting wire 35 electrically connects alarm means 50 to a pair of electrical contacts 36, 37 positioned adjacent the upper end 28 of housing 20 and adjacent actuator assembly 60. Electrical conducting wire 38 completes an electrical circuit between alarm means 50 and LED 39 for indicating the operational status of the alarm means as will be described.

The defense fluid means 40 is positioned within housing 20 adjacent upper end 28. Defense fluid means 40 preferably comprises an aerosol canister 41 sized to fit cavity 21 of housing 20 and containing a pressurized defense fluid 42. Aerosol canister 41 comprises a release valve 44 adjacent its upper end for controllably discharging defense fluid 42 in response to downward movement of the actuator assembly 60 as will be described. The aerosol canister 42 is removably received in housing 20 so that it is replaceable when the defense fluid 42 is expended, or may be removed from the housing altogether so that the apparatus may be used in jurisdictions which restrict the use of a defense fluid.

Aerosol canisters containing pressurized defense fluids of the type utilized by the apparatus of the invention are well known in the art and are manufactured, for example, by Enviro Pac, International of Lincoln, R.I. The defense fluid 42 may be any substance intended to temporarily incapacitate an attacker when the defense fluid comes in direct contact with the eyes, nose or mouth of the attacker. Preferably, however, defense fluid 42 is a conventional tear gas, MACE® or (cayenne) pepper gas.

The alarm means 50 is positioned within housing 20 adjacent the lower end 28. Preferably, alarm means 50 comprises an alarm circuit 52 electrically connected to the positive and negative terminals 54 of a battery 56. The alarm circuit 52 is provided with holes therethrough for securing the alarm circuit to right half 12 of body 10. The holes may receive solid posts (not shown) provided in right half 12 or may receive screws 53 which engage internally threaded posts (not shown) provided in right half 12 of body 10. Terminals 54 are secured on alarm circuit 52 in any conventional manner for receiving battery 56 therebetween. Battery 56 is replaceable and may be accessed through a battery access door 57 provided on the exterior surface 22 of housing 20 without separating right half 12 and left half 14.

In a preferred embodiment, the battery 56 is a miniature 12 volt battery for energizing a siren 58. The siren 58 is of a conventional type, available in different sizes for different applications, but is specially manufactured and sized to fit cavity 21 of housing 20. The base 18 of body 10 is provided with at least one, and preferably a plurality, of openings 59 therethrough defining a speaker grill for projecting the sound of siren 58 away from housing 20. The siren 58 produces an audible alarm in a range between about 80 and 150 decibels. Although the volume of the audible alarm is preferably greater than 120 decibels, certain jurisdictions may limit the decibel level of audible alarms to 120 decibels.

First electrical conducting wire 35 electrically connects the alarm circuit 52 to the pair of electrical contacts 36, 37 adjacent the upper end 28 of housing 20 and actuator assembly 60. Electrical contacts 36, 37 are made of a conducting material and contact 36, in particular, is preferably made of spring-tempered beryllium having an elastic memory. Contact 36 is biased away from contact 37 in the direction of the actuator assembly 60 so that contacts 36, 37 do not normally complete an electrical circuit between battery 56 and siren 58. As will be described hereafter, when electrical contact 36 is pressed into physical contact with electrical contact 37, however, an electrical circuit is completed between battery 56 and siren 58 to activate alarm means 50.

Second electrical conducting wire 37 electrically connects LED 39 and alarm circuit 52. LED 39 completes an electrical circuit with alarm circuit 52 to indicate a predetermined operational status of the apparatus. For example, LED 39 may indicate a low power condition of battery 56. Similarly, the apparatus may be configured to include a second pair of electrical contacts adjacent the upper end of the housing and the actuator assembly, and a third electrical conducting wire extending between the second pair of contacts and the LED. In this configuration, LED 39 may indicate that the apparatus is in a "ready" position as will be described hereafter. As shown, however, LED 39 is preferably electrically connected to battery 56 and siren 58 to indicate that the alarm means 50 is activated. In this preferred embodiment, the LED 39 informs a deaf user that the alarm means 50 is activated, or reveals to a hearing user that the battery 56 is too weak to energize the siren 58.

Figure 7:
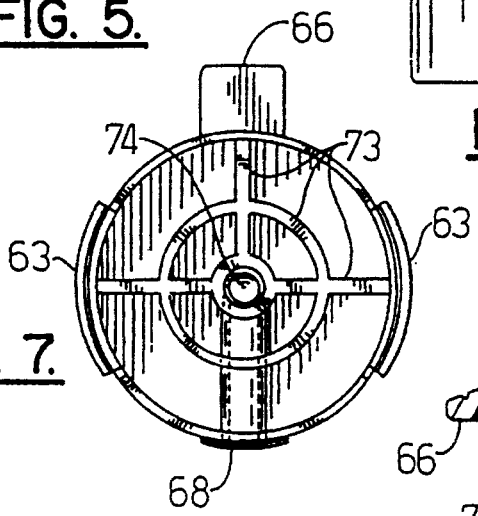
FIG. 7 is a bottom plan view of the actuator button of the personal defense apparatus of FIG. 1.
Figure 8:
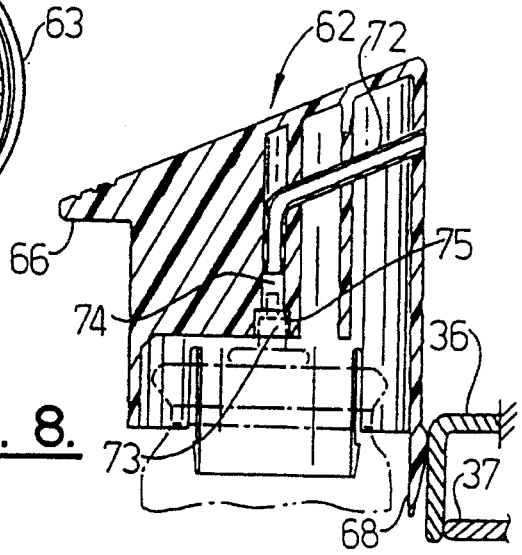
FIG. 8 is a sectional view of the actuator button of FIG. 7 taken along line 8—8.

The actuator assembly 60 (FIGS. 5–10) is removably secured to housing 20 adjacent upper end 28. Actuator assembly 60 preferably comprises a generally cylindrical actuator button 62 and a generally annular actuator collar 64. As best shown in FIGS. 7 and 8, actuator button 62 comprises a pair of diametrically opposed, radially projecting, resilient catches 63. Catches 63 snappingly engage a lower lip 65 (FIG. 6) on collar 64 so that actuator button 62 is slidably retained within collar 64. The downward travel of actuator button 62 is arrested by outwardly extending tab 66 while the upward travel of the actuator button is arrested by the upper edges of the catches 63 contacting the underside of lower lip 65. When secured within collar 64, actuator button 62 is rotatable between predetermined positions as will be described hereafter.

A portion of the lower lip 65 of collar 64 has a channel 67 (FIG. 3, FIG. 5) formed therein. Channel 67 receives a ridge 27 (FIGS. 9*a–d*) provided on a portion of the interior circumference of the upper end 28 of housing 20 in bayonet engagement to secure actuator assembly 60 to housing 20. Channel 67 frictionally engages ridge 27 so that a predetermined amount of force is required to position collar 64 on housing 20. Accordingly, collar 64 is frictionally retained on housing 20 while actuator button 62 is vertically slidable and rotatable relative to collar 64 and housing 20.

As shown in FIG. 8, actuator button 62 comprises a downwardly extending, resilient stem 68 located on the forward edge opposite tab 66 adjacent the lower end of the actuator button between catches 63. Stem 68 projects radially a sufficient amount to press biased electrical contact 36 against electrical contact 37 to complete an electrical circuit between battery 56 and siren 58 of alarm means 50. Thus, when stem 68 is circumferentially aligned with the pair of electrical contacts 36, 37, actuator button 62 activates alarm means 50.

Actuator button 62 has an opening adjacent its upper end defining a nozzle 70 (FIGS. 1 and 3) for discharging the defense fluid 42 when the nozzle is aligned with an elongate opening 71 through collar 64. A nozzle tube 72 extends between the nozzle 70 and a cavity 74 centrally positioned on the underside of actuator button 62. Nozzle tube 72 thereby defines a passageway for conveying defense fluid 42 from aerosol canister 41 to nozzle 70. Preferably, nozzle tube 70 has an included angle greater than 90 degrees but less than 180 degrees to readily convey the defense fluid 42 from aerosol canister 41.

Cavity 74 comprises a reduced diameter portion 73 sized to receive the upper portion of release valve 44 of aerosol canister 41, and defining a shoulder 75 within cavity 74. The shoulder 75 engages the lower portion of release valve 44. Thus, when actuator button 62 is depressed, pressurized defense fluid 42 is discharged. A plurality of ribs 73 arranged in a predetermined pattern stiffen the actuator button 62 sufficiently to ensure that the release valve 44 discharges the defense fluid 42 when the actuator button is depressed.

Actuator button 62 may be positioned in one of the four predetermined positions illustrated in FIGS. 9*a–d*. As shown in FIG. 9*a*, actuator button 62 may be positioned in an off, or "safety" position wherein tab 66 is rotated to the far right-hand side of collar 64 beyond detent 69, and stem 68 is rotated to the far left-hand side of collar 64. As described above, the upper edges of catches 63 contact the underside of lower lip 65 to arrest the upward travel of actuator button 62 and prevent the actuator button from further rotating and riding up on the shoulder 61 of collar 64. In the safety position, a user cannot depress actuator button 62 to activate the defense fluid means 40.

Actuator button 62 may also be positioned in a "ready" position wherein tab 66 is rotated to the far left-hand side of collar 64 adjacent a ramp 76 extending downwardly from shoulder 75, and stem 68 is rotated to the far right-hand side of collar 64. In the ready position, tab 66 rests against ramp 76 and catches 63 prevent tab 66 from further rotating and riding up on the shoulder 61 of collar 64. In the ready position, a user can rotate tab 66 to the center position (FIG. 9*c*) to activate alarm means 50 as will be described. A user can also depress actuator button 62 to activate alarm means 50 and defense fluid means 40 simultaneously. When actuator button 62 is depressed from the ready position, tab 66 and stem 68 are rotated to the center as tab 66 travels along ramp 76. Thus, stem 68 presses contact 36 against contact 37 and alarm means 50 is automatically activated as actuator button 62 activates defense means 40.

Actuator button 62 may also be positioned in an "alarm" position wherein tab 66 and stem 68 are rotated to the center of collar 64. In the alarm position, stem 68 is aligned with electrical contact 36 and alarm means 50 is activated as described above. A user can then, if necessary, depress the actuator button 62 to activate defense fluid means 40. It should be noted that detent 68 on collar 64 prevents actuator button 62 from inadvertently being rotated from the safety position to the ready or alarm positions. Accordingly, actuator button 62 may be selectively positioned to provide protection against an attacker in different situations.

The apparatus illustrated in FIGS. 1–10 and disclosed herein, is assembled by connecting electrical conducting wires 35 and 38 to alarm circuit 52. Alarm circuit 52, including siren 58 is positioned within right half 12 of body 10 adjacent base 18 and secured as previously described. First electrical conducting wire 35 is routed through the hollow portion of strike element 30 and electrical contacts 36, 37 are secured adjacent the opposing end of right half 12. Second electrical conducting wire 38 is routed partially through the hollow portion of strike element 30 to LED 39. Battery 56 is attached to alarm circuit 52 between terminals 54. Left half 14 is then secured on right half 12 with screws 16.

Aerosol canister 41 is inserted into cavity 21 of housing 20 formed by right half 12 and left half 14 of body 10, and positioned adjacent upper end 28. Actuator assembly 60 is then inserted into housing 20 over release valve 44 of aerosol canister 41 with elongated opening 71 of collar 64 rotated approximately one-quarter turn from its forward-facing position and channel 67 aligned with ridge 27 of housing 20. Thereafter, collar 64 is rotated approximately one-quarter turn to secure actuator assembly 60 to housing 20 in bayonet engagement as previously described.

Tab 66 is typically positioned in the safety position until the user begins the exercise activity. At that time, tab 66 is typically positioned in the ready position so that the alarm means 50 and the defense means 40 are available during the exercise activity. As tab 66 is moved from the safety to the ready position, alarm means 50 will be momentarily activated and siren 58 will sound to indicate that the alarm means is functional. In use, the user grasps handgrip 24 between the fingers and palm of one hand and rests the thumb of the hand on the top of actuator button If attacked, the user can rotate tab 66 to the alarm position with the thumb of the hand to activate alarm means 50 to summon assistance to the scene of the attack. Alternatively, the user can depress actuator button 62 with the thumb of the hand so that tab 66 rides downwardly along ramp 76 to simultaneously activate alarm means 50 to sound siren 58 and defense means 40 to discharge defense fluid 42 from aerosol canister 41 through nozzle 70. If necessary, the user may also strike the attacker with strike bar 32 of strike element 30. Accordingly, the user is protected against an attacker by an audible alarm to summon help, a defense fluid to temporarily incapacitate the attacker, and a hard, rigid strike bar to combat the attacker.

Figure 11:
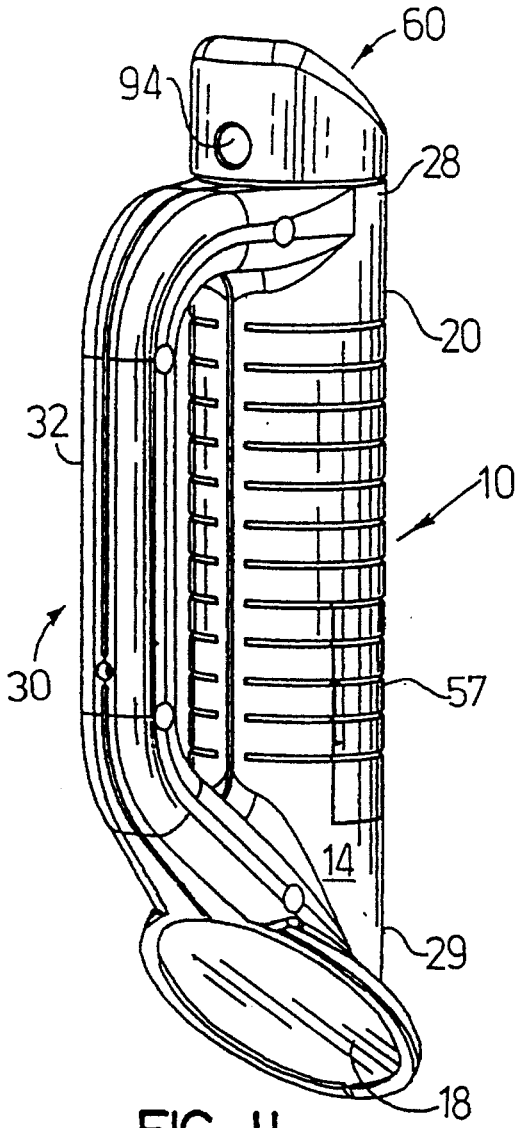
FIG. 11 is a front perspective view of an alternative embodiment of a hand-held personal defense apparatus according to the invention.
Figure 12:
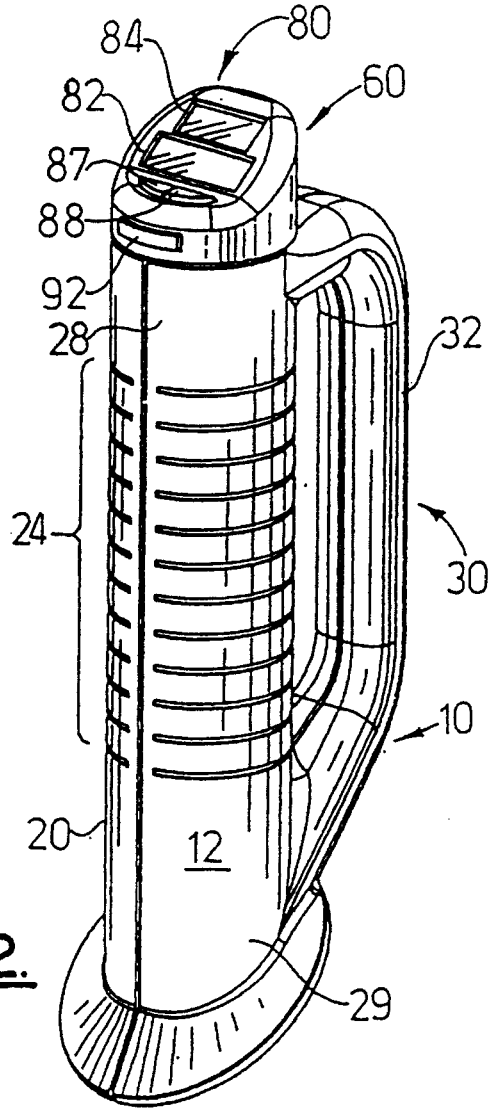
FIG. 12 is a rear perspective view of the personal defense apparatus of FIG. 11.

In an alternative embodiment, the body 10 of the apparatus is utilized to hold the components of a companion exercise apparatus. The companion exercise apparatus is illustrated in the perspective views of FIGS. 11 and 12. In this alternative embodiment, actuator assembly 60 is configured to comprise a timing means 80, and defense fluid means 40 and alarm means 50 are removed from housing 20 and replaced by an illuminating means 90 and a storage means 100, respectively.

Timing means 80 preferably comprises a conventional stop watch 82 and a conventional pedometer 84 positioned within actuator button 62 and powered by an internal watch battery 86 (not shown). Timing means 80 provides the user with information related to the time expended and the distance completed during the exercise activity. The time and distance information is digitally displayed on displays on the top of actuator button 62 in a known manner. Common function buttons 87, 88, for example, stop/start, split indicator, reset and mode (miles or kilometers) buttons, are further provided on actuator button 62 adjacent stop watch 82 and pedometer 84. In a preferred embodiment, LED 39 is replaced by a plug 89 for a conventional pulsemeter that is electrically connected to the display of pedometer 84.

Illuminating means 90 preferably comprises a conventional flashlight (not shown) positioned within housing 20 adjacent upper end 28 in place of aerosol canister 41. Illuminating means 90 is preferably battery-powered, for example by a 9 volt battery (not shown) located within housing 20 adjacent battery access door 57. A control switch 92 is provided on the lower lip 65 of collar 64 for turning the flashlight on and off and for illuminating the displays of timing means 80. The flashlight comprises a light lens 94 positioned in the elongated opening 71 of collar 64 in place of nozzle 70 of the hand-held personal defense apparatus. Nozzle tube 72 is configured to convey the illumination produced by the flashlight to light lens 94.

Storage means 100 preferably comprises a storage compartment (not shown) positioned within housing 20 adjacent lower end 29. The battery access door 57 on left half 14 of body 10 may be utilized to provide access to the storage compartment. Preferably, however, base 18 is removably attached to body 10 to provide access to the storage compartment. The holes 17 in base 18, however, are preferably plugged as shown so that the storage compartment is safeguarded from the elements when battery access door 57 is closed. The storage compartment is preferably utilized by a user for storing personal items commonly carried by an exerciser, such as keys or money.

The companion exercise apparatus is assembled in a similar manner as the personal defense apparatus. The personal defense apparatus and companion exercise apparatus preferably have approximately the same weight. Thus, an exerciser may use the two together, with the personal defense apparatus in one hand and the exercise apparatus in the other hand, to balance the aerobic exercise benefit provided by the increased resistance to the movement of the arms of the exerciser. When used in this manner, the personal defense apparatus and exercise apparatus further function as exercise weights.

Obviously, many alternative embodiments of the invention are within the ordinary skill of those skilled in the art. Therefore, it is not intended that the invention be limited to the preceding description of illustrative preferred embodiments, but rather that all embodiments that fall within the spirit and scope of the invention disclosed above and claimed herein be included.

That which is claimed is:

1. A hand-held personal defense apparatus for protecting a user against an attacker, said apparatus comprising:

a hollow housing defining an elongate handgrip and comprising an upper end and a lower end;

a strike element connected to at least one of said upper end and said lower end of said housing, said strike element comprising a rigid strike bar which extends in spaced relation along at least a substantial portion of the length of said handgrip so that the hand of the user may surroundingly grip said handgrip with said strike bar exposed on the outside of the hand;

alarm means positioned within said hollow housing for emitting an audible alarm;

defense fluid means positioned within said hollow housing for discharging a defense fluid; and actuator means positioned adjacent said upper end of said housing for selectively activating said alarm means and for selectively activating said defense fluid means.

2. The defense apparatus of claim 1 wherein said actuator means comprises an actuator button movable relative to said housing to selectively activate said alarm means and to selectively activate said defense fluid means; and a collar having a cavity for slidably receiving said actuator button therein.

3. The defense apparatus of claim 2 wherein said actuator button comprises an outwardly extending tab and said collar has a slot therein for permitting vertical movement of said actuator button relative to said collar.

4. The defense apparatus of claim 2 wherein said actuator button is rotatable relative to said collar to activate said alarm means and vertically movable relative to said collar to activate said defense fluid means.

5. The defense apparatus of claim 4 wherein said actuator button is rotatable between a first safety position in which said actuator button cannot be vertically moved to activate said defense fluid means, a second ready position in which said actuator button is rotatable to activate said alarm means and is vertically movable to activate said defense fluid means, and a third alarm position in which said alarm means is activated and said actuator button is vertically movable to activate said defense fluid means.

6. The defense apparatus of claim 2 wherein said actuator button comprises a downwardly extending stem and said alarm means comprises a first electrical contact and a second electrical contact, and whereby rotational movement of said actuator button presses said stem against said first electrical contact to complete an electrical circuit between said first electrical contact and said second electrical contact to activate said alarm means.

7. The defense apparatus of claim 1 wherein said alarm means comprises an alarm circuit, a battery and a siren.

8. The defense apparatus of claim 7 wherein said housing has at least one opening adjacent said lower end defining a speaker grill for projecting the sound of said siren away from said housing.

9. The defense apparatus of claim 1 wherein said defense fluid means comprises an aerosol canister containing a pressurized defense fluid selected from the group consisting of tear gas, MACE® and pepper gas

10. The defense apparatus of claim 9 wherein said aerosol canister comprises an upwardly extending release valve and said actuator button comprises a downwardly extending post having a cavity therein for receiving said release valve and wherein said release valve is opened to discharge said defense fluid when said actuator button is moved vertically downward such that said post depresses said relief valve.

11. The defense apparatus of claim 1 wherein said strike element comprises a hard, rigid, hollow tube extending outwardly from said upper end and said lower end of said housing and defining a "brass knuckles" exposed on the outside of the hand of the user for defending against an attacker.

12. The defense apparatus of claim 5 further comprising a light-emitting-diode (LED) positioned externally on said strike bar and electrically connected to said alarm means.

13. The defense apparatus of claim 12 wherein said light-emitting-diode (LED) indicates when said actuator button is in said alarm position.

14. The defense apparatus of claim 12 wherein said light-emitting-diode (LED) indicates when said actuator button is in one of said safety position and said ready position.

15. The defense apparatus of claim 12 wherein said light-emitting-diode (LED) indicates when the power of said battery of said alarm means is low.

16. The defense apparatus of claim 1 wherein said alarm means comprises an electrical siren, a battery, and electrical switch means for electrically connecting said siren to said battery upon closure thereof;

said defense fluid means comprises an aerosol canister having a depressible release valve which operates to discharge a gaseous defense fluid from said canister upon being depressed; and said actuator means comprises an actuator button mounted to said housing and selectively movable between:

(1) a first safety position;

(2) a second alarm position wherein said electrical switch means is closed to activate said siren; and (3) a third defense fluid position wherein said electrical switch means is closed to activate said siren and wherein said release valve of said aerosol canister is depressed to discharge said defense fluid.

17. The defense apparatus of claim 16 wherein said actuator button is further movable to a fourth ready position wherein said actuator button is movable to said third defense fluid position upon the actuator button being manually depressed.

18. A hand-held exercise apparatus for use by an exerciser, such as a jogger or a walker, said exercise apparatus comprising:

a hollow housing defining an elongate handgrip and comprising an upper end and a lower end;

a strike element connected to at least one of said upper end and said lower end of said housing, said strike element comprising a rigid strike bar which extends in spaced relation along at least a substantial portion of the length of said handgrip so that the hand of the user may surroundingly grip said handgrip with said strike bar exposed on the outside of the hand;

timing means positioned within said hollow housing for providing time and distance information related to the exercise activity;

illuminating means positioned within said hollow housing for providing illumination for exercising at night or in unlit areas; and storage means positioned within said hollow housing for storing items commonly carried by an exerciser such as money or keys.

* * * * *